United States Patent [19]

Antes

[11] 4,429,742

[45] Feb. 7, 1984

[54] TUBULAR ALIGNMENT ASSEMBLY

[75] Inventor: Ronald E. Antes, Rickmansworth, England

[73] Assignee: Marathon Oil Company, Findlay, Ohio

[21] Appl. No.: 270,683

[22] Filed: Jun. 4, 1981

Related U.S. Application Data

[63] Continuation-in-part of Ser. No. 64,144, Aug. 6, 1979.

[51] Int. Cl.[3] ..... E21B 19/16

[52] U.S. Cl. ..... 166/127; 166/133; 166/136; 166/165; 166/316

[58] Field of Search ..... 405/195, 224, 231, 232; 166/242, 332; 285/3, 18, 24, 27, 308; 29/781, 789, 240; 33/180 R; 166/133, 136, 165, 316, 188, 191

[56] References Cited

U.S. PATENT DOCUMENTS

| | | | |
|---|---|---|---|
| 1,025,759 | 5/1912 | McCluskey | 285/27 |
| 1,225,855 | 5/1917 | Pruyn | 285/27 |
| 2,963,090 | 12/1960 | Cole et al. | 166/85 |
| 3,485,051 | 12/1969 | Watkins | 61/46.5 |
| 3,533,241 | 10/1970 | Bowerman et al. | 61/46.5 |
| 3,577,737 | 5/1971 | Burleson | 61/46.5 |
| 3,613,381 | 10/1971 | Cox | 61/46.5 |
| 3,859,806 | 1/1975 | Guy et al. | 61/46.5 |
| 4,142,371 | 3/1979 | Mayfield et al. | 405/224 |

*Primary Examiner*—Stephen J. Novosad
*Assistant Examiner*—Joseph Falk
*Attorney, Agent, or Firm*—Jack L. Hummel

[57] ABSTRACT

Hollow tubular members used as piling to support offshore platforms and the like are more easily aligned with a stabbing means. The base of the stabbing means is flexibly attached to the inner surface of one end of a tubular member; the tip of the stabbing means, which is rounded and pointed, projects beyond the end of the tubular member. The stabbing means can be attached to the tubular member for easy removal and can be adapted to couple with a retaining device within a companion tubular member that is to be aligned with the first tubular member. Preferably, a cable is coiled within an elastomeric material that flexibly bonds the stabbing means to the tubular member—the cable can be pulled or ripped from the material to destroy the bond and thereafter permit removal of the stabbing means.

3 Claims, 2 Drawing Figures

TUBULAR ALIGNMENT ASSEMBLY

CROSS REFERENCE TO RELATED APPLICATIONS

This application is a continuation-in-part of copending U.S. patent application Ser. No. 064,144, filed Aug. 6, 1979.

BACKGROUND OF THE INVENTION

This invention provides a means and apparatus for coupling tubular members of the type used in piling for offshore platforms. It particularly relates to the use of a flexible or non-rigid stabbing means assembly to provide increased alignment tolerances and to assist in correcting minor misalignments. The stabbing means can be left in place, as a plug, or removed as desired.

The need for some form of a flexible stabbing means for aligning and joining successive sections of tubular members used in piling and the like is needed, especially where lateral movement of the members is difficult to control.

U.S. Pat. No. 1,025,759 teaches a resilient, malleable metal sleeve which is attached with bolts in the end of one tubular member. When the projecting end of the sleeve is forced into a companion tubular member, "spring-like" projections from the sleeve cause the sleeve to tightly "hug" the other pipe to facilitate alignment of the members.

U.S. Pat. No. 1,225,855 teaches the use of a cast steel or malleable iron bushing to align contiguous segments of steel and concrete piles. The bushing is shaped to snugly fit within the interior of the piles. A flange upon the bushing bisects the bushing and separates the two abutting piles.

U.S. Pat. No. 2,963,090 teaches a rigid aligning means to permit the mounting of a blowout preventor on top of a well casing.

These early devices have not satisfied the need for better alignment and coupling devices. This is illustrated by U.S. Pat. No. 3,485,051 which teaches a complex funnel shaped device and probe assembly with a double tapered guidance apparatus.

The need for rupturable piling guides is demonstrated in U.S. Pat. No. 3,533,241 which teaches a rupturable seal assembly for closing the lower ends of tubular members. This facilitates the floating of platforms to points of installation and prevents the entry of silt and other debris when the tubular members are placed on the bottom prior to the driving of pilings or the drilling of wells. A rubber diaphragm is used as the rupturable seal member.

U.S. Pat. No. 3,577,737 teaches the use of a device which compresses a rubber plug, when desired, to effect a seal within a tubular member.

Another mechanical plug is taught in U.S. Pat. No. 3,613,381 wherein the closure member is in the form of a truncated cone welded at its periphery to the inner wall of the tubular member. The cone is equipped with a tearing arm which, when pulled, tears the conical plug from the inner surface of the tubular member.

The continuing existence of the problem of tubular alignment is further exemplified by U.S. Pat. No. 3,859,806 wherein a drogue and probe are affixed to the legs of jackets or substructure components of an offshore platform. The drogue has longitudinal slots into which latches on the surface of the probe fit.

U.S. Pat. No. 4,142,371 teaches a removable closure apparatus for hollow tubular members. A cable is coiled within the annulus of a moldable material that acts as the seal between the interior of the tubular member and the apparatus. The seal is broken when the cable is torn from the moldable material, permitting removal of the closure.

The recited art shows the need for a flexible stabbing means which can be a plug, part of a drogue and probe assembly, can latch into a mating part on another tubular member and which can be removed with relative ease. This invention provides the means for accomplishing all of these results simply and inexpensively.

BRIEF DESCRIPTION OF THE DRAWINGS

In FIG. 1, tubular member 11 is lowered onto tubular member 12 and the abuttment is maintained in alignment by the flexible stabbing means. Flexible attachment ring 13 is bonded to tubular member 11 and the base portion 10 of stabbing means 9. Retention of stabbing tip 14 within guide ring 15 is effected by latch assemblies 16. The frustonoconical portion of stabbing tip 14 makes contact with guide ring 15 during the lowering of tubular member 11 onto tubular member 12 and then contacts compressible "O" ring 17 forcing the alignment of the tubular members. Latch assemblies 16 are forced, on contact, inwardly against spring 18 fitted into retaining bracket 19 during the descent of tubular member 11 and are returned to their original position by spring 18 when abuttment is completed, thereby locking tubular members 11 and 12 in substantial alignment.

Figure 1:
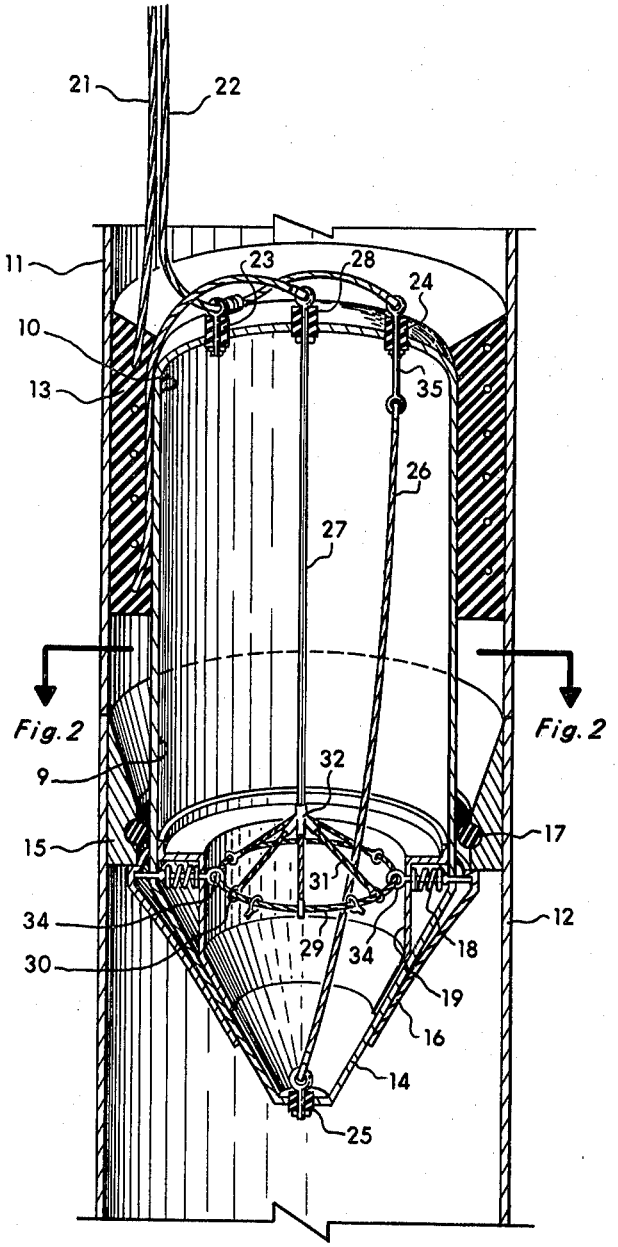
FIGS. 1 and 2 depict a side and top view, respectively, of the alignment assembly of this invention.

Further action with regard to the stabbing means is controlled by cables 21 and 22. Fluid flow between tubular members 11 and 12 is accomplished by an upward pull on cable 22 which pulls vent plugs 23 and 24 from attachment to stabbing means 9. Finally, vent plug 25 is opened on stabbing tip 14 by continued pull on cable 26 which is connected via attachment 35 to cable 22. Vent plugs 23, 24, and 25 can be of any desired size, depending upon the rate of fluid flow desired.

Stabbing means 9 is removed from its position within the abutting tubular members 11 and 12 by an upward pull on ripout cable 21 which tears the coiled cable from its position within flexible attachment ring 13 thereby substantially destroying ring 13. A continued pull on cable 21 lifts extraction rod 27 through seal 28 which in turn retracts latches 16 from guide ring 15.

Figure 2:
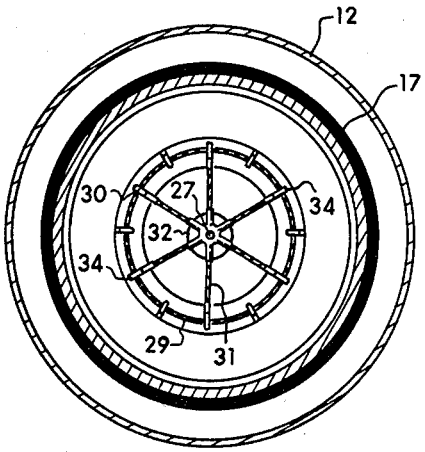

FIG. 2 depicts a section cut through points indicated on FIG. 1. FIG. 2 shows a top view of the assembly used to remove the stabbing means. Harness 29 is connected to extraction rod 27 by means of cable retainer 32, equalizing rings 30, and harness connectors 31. Harness connectors 31 and rings 30 insure an equal horizontal pull on eyebolts 34. Compression springs 18 permit retraction of latch assemblies 16 when a vertical pull is exerted on extraction rod 27.

DESCRIPTION OF THE INVENTION

The invention is a hollow tubular alignment assembly utilizing a flexible stabbing means. The base of the stabbing means is bonded to the inner surface of the end of a tubular member; the tip or the front portion of the stabbing means protrudes beyond the end of the tubular member. The stabbing means is adapted both to facilitate the mating of the tubular member with a companion tubular member and to plug the hollow ends of the tubular members.

An embodiment of this invention as shown in the drawings contains elements which provide for a variety of functions. Tubular members 11 and 12 abut one another and are maintained in alignment by stabbing means 9. Base 10 of the stabbing means is bonded to flexible attachment ring 13 which in turn is bonded to tubular member 11. Tip 14 of stabbing means 9 is retained within guide ring 15 of tubular member 12 by latch assemblies 16.

Alignment and latching are accomplished by lowering tubular member 11 onto tubular member 12. The frustoconical portion of stabbing means 9 makes contact with guide ring 15 within tubular member 12 and then with compressible "O" ring 17 thereby aligning tubular members 11 and 12. The latch assemblies 16 are forced, on contact, inwardly against spring 18 fitted into retaining bracket 19 during the descent of stabbing means 9 into tubular member 12. Latches 16 are returned to the original position by spring 18 when abuttment of tubular members 11 and 12 are completed, thereby locking tubular members 11 and 12 in substantial alignment.

Once the tubular alignment assembly is locked into place, the ends of the tubular members 11 and 12 are aligned and effectively plugged. Thereafter, the tubular members can be welded, if desired, and thereafter driven down into the subsurface as pilings are normally done. If it is desired to remove the stabbing means 9, an upward pull on ripout cable 21 tears or ruptures flexible attachment ring 13 to free stabbing means 9 from tubular member 11.

The flexible attachment ring 13 can be made of any suitable flexible or elastic material such as foamed in place plastic, natural or synthetic rubbers, or other materials which can be effectively destroyed by the upward pull of a rope or a cable using an amount of force consistent with the structural integrity of the entire system.

when ripout cable 21 is completely unwound from its coiled position within flexible attachment ring 13, continued pulling on cable 21 exerts an upward force on extraction rod 27. Extraction rod 27 is pulled upwardly through seal 28 which in turn causes an upward lift on cable retainer 32 and harness connectors 31. Harness connectors 31 and equalizing rings 30 translate the vertical force exerted by cable 21 into a horizontal force on harness 29.

When a horizontal pulling force is applied to harness 29 which is looped through the eyebolts 34 which are connected to latch assemblies 16, the latches retract beyond guide ring 15 thereby allowing stabbing means 9 to move upwardly past guide ring 15 and compressible "O" ring 17.

If it is desired that the pressure between hollow tubular members 11 and 12 be equalized, cable 22 is pulled upwardly causing vent plugs 23, 24 and 25 to be freed, creating vents in the voids formerly occupied by vent plugs 23, 24 and 25 and allowing the passage of fluid through stabbing means 9. Where it is desired to equalize pressure prior to removing stabbing means 9, cable 22 is pulled first or at the same time or immediately subsequently to pulling on cable 21 to destroy flexible attachment ring 13.

While one embodiment of the invention has been shown, a number of others are obvious. For example, tubular member 11 and tubular member 12 can be of different diameters. Also, the alignment assembly can be used without vent plugs 23, 24 and 25 and latching assemblies 16.

Various modifications of the device of this invention can be readily conceived for various uses. It is intended that all such embodiments be included within the scope of the following claims.

What is claimed is:

1. A tubular alignment assembly comprising an elongated stabbing means adapted to assist alignment of first and second hollow tubular members being positioned end to end, said tubular alignment assembly shaped to conform to the interior of the tubular members to be aligned and having a base portion flexibly attached to the end portion of the first tubular member and having a stabbing tip protruding beyond the end portion and shaped to engage and align said first tubular member with the second tubular member when the ends of the first and second tubular members are positioned end to end, wherein the tubular alignment assembly has a latching means in the stabbing tip adapted to lock the first tubular member into the second tubular member when said members are positioned end to end.

2. The tubular alignment assembly of claim 1 wherein the latching means engages and is retained by a retaining means affixed in the end portion of the second tubular member.

3. A tubular alignment assembly comprising an elongated stabbing means adapted to assist alignment of first and second hollow tubular members being positioned end to end, said tubular alignment assembly shaped to conform to the interior of the tubular members to be aligned and having a base portion flexibly attached to the end portion of the first tubular member to hermetically seal one end of the first tubular member from the other end and having a stabbing tip protruding beyond the end portion and shaped to engage and align said first tubular member with the second tubular member when the ends of the first and second tubular members are positioned end to end, wherein the tubular alignment assembly includes vent opening means and vent closure means.

* * * * *